United States Patent [19]

Kelso et al.

[11] 4,327,345

[45] Apr. 27, 1982

[54] SOLENOID HAVING A MULTI-PIECE ARMATURE

[75] Inventors: Charles R. Kelso, Farmington Hills; Endre A. Mayer, Birmingham, both of Mich.

[73] Assignee: The Bendix Corporation, Southfield, Mich.

[21] Appl. No.: 238,777

[22] Filed: Feb. 27, 1981

Related U.S. Application Data

[63] Continuation of Ser. No. 71,914, Sep. 4, 1979, abandoned.

[51] Int. Cl.[3] ..... H01F 7/13; H01F 7/16

[52] U.S. Cl. ..... 335/265; 335/259; 251/129

[58] Field of Search ..... 335/265, 259, 267, 256; 251/129, 131

[56] References Cited

U.S. PATENT DOCUMENTS

| | | | |
|---|---|---|---|
| 2,881,367 | 4/1959 | Watson | 335/256 |
| 2,895,090 | 7/1959 | Short | 335/256 |
| 3,473,780 | 10/1969 | Harms | 335/259 |
| 3,763,412 | 10/1973 | Detrick et al. | 310/14 |
| 3,805,099 | 4/1974 | Kelly | 335/259 |
| 3,961,298 | 6/1976 | Jaffe et al. | 335/265 |

FOREIGN PATENT DOCUMENTS

| | | |
|---|---|---|
| 306093 | 6/1918 | Fed. Rep. of Germany . |
| 426302 | 3/1926 | Fed. Rep. of Germany . |
| 447310 | 7/1927 | Fed. Rep. of Germany . |
| 548390 | 4/1932 | Fed. Rep. of Germany . |
| 1205106 | 1/1960 | France . |
| 1428611 | 1/1965 | France . |
| 683032 | 11/1952 | United Kingdom . |

*Primary Examiner*—Harold Broome

*Attorney, Agent, or Firm*—Markell Seitzman; Russel C. Wells

[57] ABSTRACT

An electromagnetic solenoid is adapted to open and close an associated valve or to reciprocally engage a slideable member. The solenoid includes an electromagnetic and multi-piece armature enclosed within a protective housing. The armature comprises an inner pole piece operatively connected to an outer pole piece to initially provide a multi-level air gap with respect to the electromagnet. The inner pole piece is telescopically received within the outer pole piece and may overtravel the outer pole piece once the motion of the outer pole piece has ceased.

7 Claims, 12 Drawing Figures

20
62
48a
78
100
45
48b
92
96
98
94
3
88
76
36
90
84
83
86
42
40
30
44
46
70
74
69
72
38
34
62a
62b
62c
66
68
60
64
32
T/2
3

20
30
32
34
36
38
40
42
44
45
46
48a
48b
60
60a
60b
62
64
66
68
69
70
72
74
76
78
79
80
83
84
86
88
90
92
94
96
98
100
T/2

SOLENOID HAVING A MULTI-PIECE ARMATURE

This is a continuation of application Ser. No. 71,914, filed Sept. 4, 1979, now abandoned.

BACKGROUND

1. Field of the Invention

This invention relates to electromagnetic solenoid valves and actuators having rapid response time and extended stroke. More particularly, the invention relates to such devices having a single electromagnet and a telescoping armature.

2. Prior Art

Solenoid actuators are known in the art. These actuators often comprise a moveable armature maintained in a spaced relationship from an electromagnet. The distance therebetween, called an air gap, thereby defines the stroke of the armature. It is desirable to obtain a fast acting actuator having a long stroke. However, increasing the stroke implies a larger air gap which further implies developing a greater magnetic field to produce the requisite force to attract the moveable armature. One method of developing these larger forces is to increase the size of the magnetic circuit requiring a larger stator, coil and armature as well as requiring larger excitation currents. However, these larger units often take a greater time to build up or energize and deenergize the required magnetic field. Similarly, the response time of the armature is slowed because of its increased mass or inertia. It should be noted that it is not possible to fully compensate for these longer response times merely by increasing the level of exciting current and that the increased currents may only produce excessive local heating and power usage.

SUMMARY OF THE INVENTION

The present invention relates to an electromagnetic solenoid responsive to electric actuation commands. The solenoid may be used as an actuating device to move an associated member into or away from a housing or as a ported valve to controllably open and close a passage threin permitting fluid to flow therethrough. The solenoid comprises a multi-piece armature moveably situated, within a housing, with respect to an electromagnet. The preferred embodiment employs a laminated E-type electromagnet or stator and an armature having substantially rectangular pole pieces which conform to the substantially rectangular E-type electromagnet. Other electromagnets such as a cylindrical electromagnet and armature configurations may be substituted. The multi-piece armature comprises inner and rear pole pieces maintained in a spaced relationship apart and biased from the electromagnet. The inner and rear pole pieces in their deactivated mode are telescopically received one into the other and are sized to define a bi-level air gap relative to the electromagnet. Activation of the solenoid produces a non-uniform magnetic force which attracts both pole pieces to the electromagnet. The bi-level air gap of the preferred embodiment is one in which one pole piece is initially maintained at a smaller air gap than the other pole piece. This relationship permits large electromagnetic forces to be exerted upon the closer pole piece. This large force is sufficient to move both pole pieces towards the electromagnet thereby similarly reducing the air gap related to the farther spaced pole piece. As the armature approaches the electromagnet the force exerted upon the initially farther pole piece increases dramatically to a level sufficient to continue to pull the farther pole piece to the electromagnet. The telescopic relationship permits the farther situated pole piece to overtravel relative to the closer pole piece once the closer pole piece has been pulled to the electromagnet.

It is preferable to prevent the armature members from contacting the stator or electromagnet. If this contact should occur, the magnetic properties of the stator and armature laminates may diminish, the uniformity of the air gap may change and the deactivation response time might increase because of the magnetic hystersis developed. The proper minimum spacing can be achieved in a number of ways such as using a non-magnetic spacer or an auxiliary stop which engages a portion of the armature prior to the contact with the stator. To develop useable motion one of the pole pieces is connected to a shaft or piston, which can be an integral part of the armature; the motion of this shaft or piston can move an associated member of a coacting device or control the opening and closing of an associated valve, vent or passageway.

The preferred embodiments of the present invention illustrate a solenoid designed to pull the piston or associated apparatus towards the solenoid housing. An alternate embodiment illustrates the use of the present invention in a solenoid designed to push the piston or associated apparatus away from the housing. A further embodiment replaces the E-type electromagnet with a C-type electromagnet.

An advantage of the present invention is that the multi-piece armature permits extended stroke, i.e., piston movement, while not requiring electromagnets having excessively large cores or coils or using excessive exciting currents.

Another advantage is rapid piston response resulting from the reduced armature mass and increased actuating force.

It is an object of the present invention to provide a solenoid having rapid response and extended stroke. Many other objects and advantages of the invention will be clear from the detailed description of the drawings.

DETAILED DESCRIPTION OF THE DRAWINGS

Figure 1:
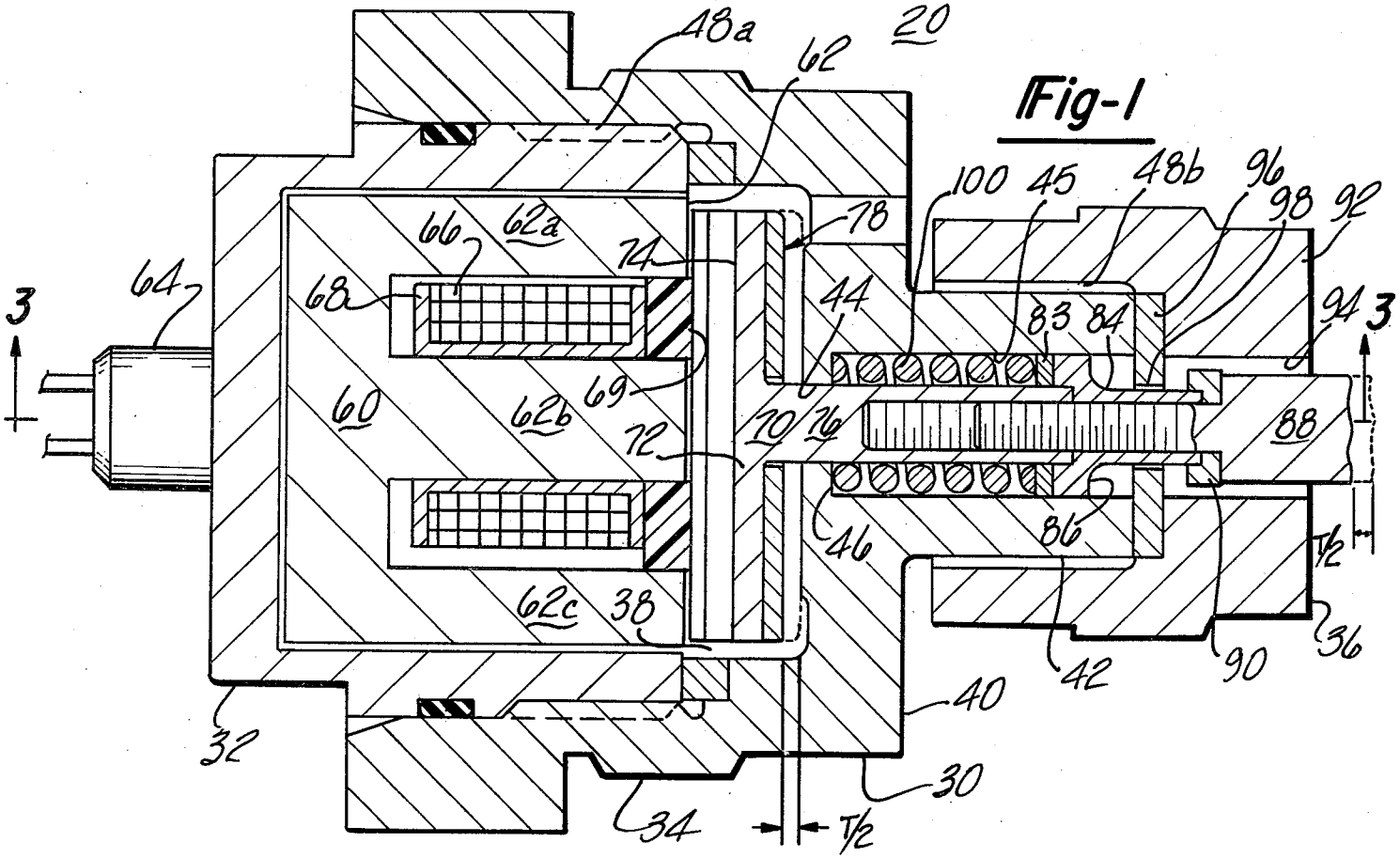
FIG. 1 is a sectional view of the present invention.
Figure 2:
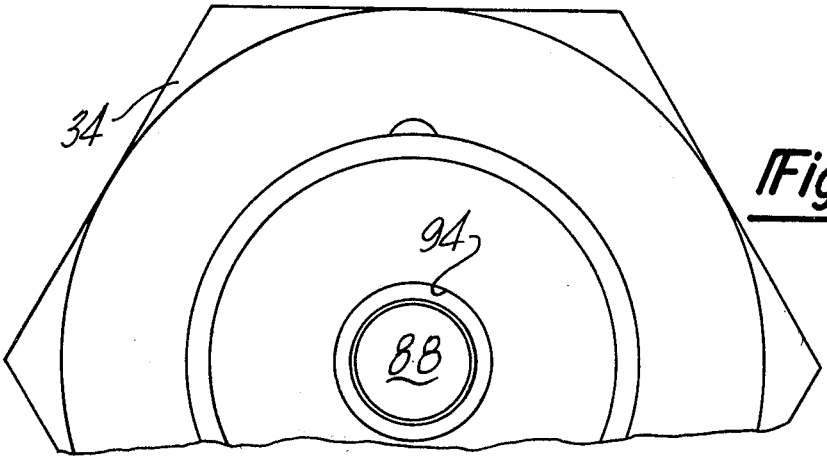
FIG. 2 is an end view.
Figure 3:
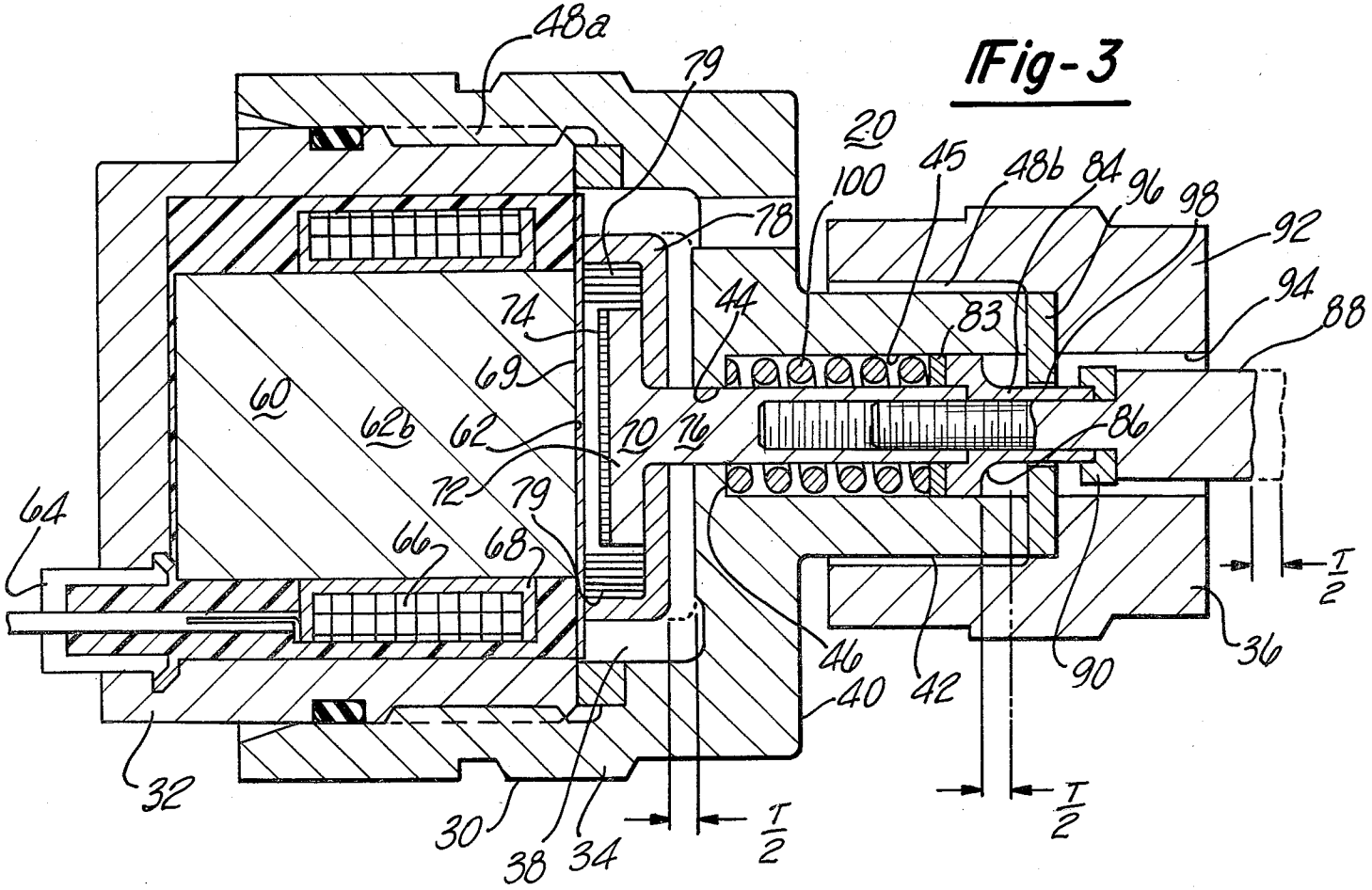
FIG. 3 is another sectional view through Section 3—3 of FIG. 1.

Reference is now made to FIGS. 1, 2 and 3 which illustrate views of the preferred embodiment of the present invention. There is shown an electromagnetic solenoid actuator 20 having a housing 30 adapted to enclose a magnetic means such as a stator or electromagnet 60 and telescoping armature 70. (The term stator and electromagnet are used interchangeably.) A resilient means such as a helical spring 100 interposes a section of the housing 30 to bias a shaft or piston 84 therebetween.

The housing 30 comprises a base portion 32, adapted to mate with an armature receiving portion 34 and a retainer portion 36 adapted to mate with the armature receiving portion 34.

In the embodiment shown in FIGS. 1, 2 and 3 the base portions 32 and armature receiving portion 34 are cup-like structures designed to interfit forming a chamber 38 therebetween to support and to enclose the stator 60 and the armature 70. The armature receiving portion 34 contains a base 40 and tubular portion 42 extending therefrom. More particularly, the tubular portion 42 contains two concentric bores such as the centrally located bore 44 and the second larger bore 45. The intersection of the bore 44 with bore 45 forms a support means such as a shoulder 46 for receiving and for supporting the helical spring 100. The tubular portion 42 is further adapted to interfit portion 36. Portion 36 functions to secure the armature 70 within the bore 45 while permitting the sliding engagement of the piston or shaft portion of armature 70. As shown, portions 32 and 34 and 36 can threadably engage one another by utilizing pairs of coacting screw threads 48*a* and 48*b*. Alternatively, snap-fittings or the press-fit engagement of the respective housing portions can be substituted for the screw threads 48*a* and 48*b*.

In the preferred embodiment of the invention, the electromagnetic stator 60 is an E-type electromagnet having poles 62*a, b, c,* and adapted to securely fit within the base portion 32 of the housing 30 and further adapted to receive electrical commands input thereto through an electrical connector such as connector 64.

The electromagnet 60 is preferably constructed using a laminated core fabricated from one of the known varieties of high silicon oriented magnetic steels. The electromagnet 60 also includes at least one coil of wire 66 wound about a suitably sized bobbin 68 which is fitted to the center leg or pole 62*b* of the E-type electromagnet. While the preferred embodiment requires an E-type electromagnet, other shapes may be substituted. The E-shape naturally follows from the fact that the high silicon oriented magnetic laminates are often available as flat stock.

The armature 70 comprises a plurality of interconnected and nested pieces. While the preferred embodiment utilizes a two piece armature 70, the present invention is amenable to other armature configurations including the multi-piece armatures shown in FIGS. 10, 11 and 12. The embodiment of the armature 70 shown in FIGS. 1 and 3 includes an inner member such as a plate-like inner pole piece 72 having a laminated poleface 74 and a rod-like member 76 protruding therefrom. The inner member is telescopically received within a receiving member such as the rear pole piece 73 which has laminated polefaces 79. This relationship is further illustrated in FIG. 4 which is an exploded diagram of the armature 70. The receiving member of the preferred embodiment is substantially rectangular to conform with the dimensions of the inner member and E-type electromagnet and partially envelopes the inner member. The partial envelopment is achieved by utilizing a rear pole piece 78 having a U-shaped cross-section. The inner and receiving members of the preferred embodiment are sized so that when both members are nested, i.e., telescopically received one into the other, poleface 74 and poleface 79 are parallel to one another but do not lie in the same plane. The significance of this uneven poleface positioning will be discussed later.

Figure 4:
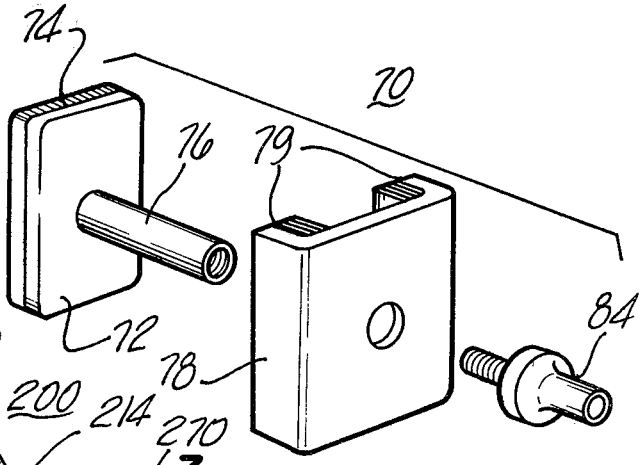
FIG. 4 illustrates an exploded view of the armature shown in FIGS. 1 and 3.

Reference is again made to FIGS. 1 and 3 which further illustrate the relationship of the armature 70 to the other components of the solenoid 20. The solenoid 20 is shown in a partially activated mode, i.e., wherein the electromagnet 60 has moved the armature 70, more particularly, the rear pole piece 78 into engagement with the spacer 69. The fully deactivated mode is where the armature 70 is biased by the spring 100 into the armature receiving portion 34 as illustrated by the phantom lines. The armature 70 further includes a spring retainer such as the washer 83 and piston 84 having a shoulder 86. The piston 84 is sized to slidably engage the interior of bore 45. The valve plate 96 further includes a centrally located hole 98 sized to permit passage of a portion of the piston 84. As illustrated in FIG. 1 or 3, the piston 84 is hollow and secured to the rod 76 by a threaded member 88. It is apparent that the member 88 can be a retaining screw, or the movable member of a coacting apparatus so activated such as a three-way valve or the spool of a spool valve of a fuel injector for automotive engines. A valve seat such as spacer or washer 90 interposes piston 84 and member 88 to ensure proper seating with the valve plate 96. Alternatively, the piston 84 can be directly secured to the rod 76 using the threaded engagement as shown in FIG. 4. In addition, that portion of piston 84 extending through the valve plate 96 in FIG. 4 can be modified to similarly threadably engage a valve or coacting apparatus.

The retainer portion 36 comprises another cup-like structure having a base 92 with passage 94 located therein. The retainer portion 36, as previously mentioned, threadably engages portion 34 securing the valve plate 96 therebetween.

It should be apparent from FIGS. 1 and 3 that in the solenoid's deactivated state, the spring 100 will bias the inner and rear pole pieces 72 and 78 respectively at positions of maximum travel with respect to the legs 62 of the electromagnet 60 therein establishing a bi-level air gap therebetween. As an example, the face of pole piece 72 may be maintained at an air gap T which is greater than the respective rear pole piece air gap of T/2.

Figure 5:
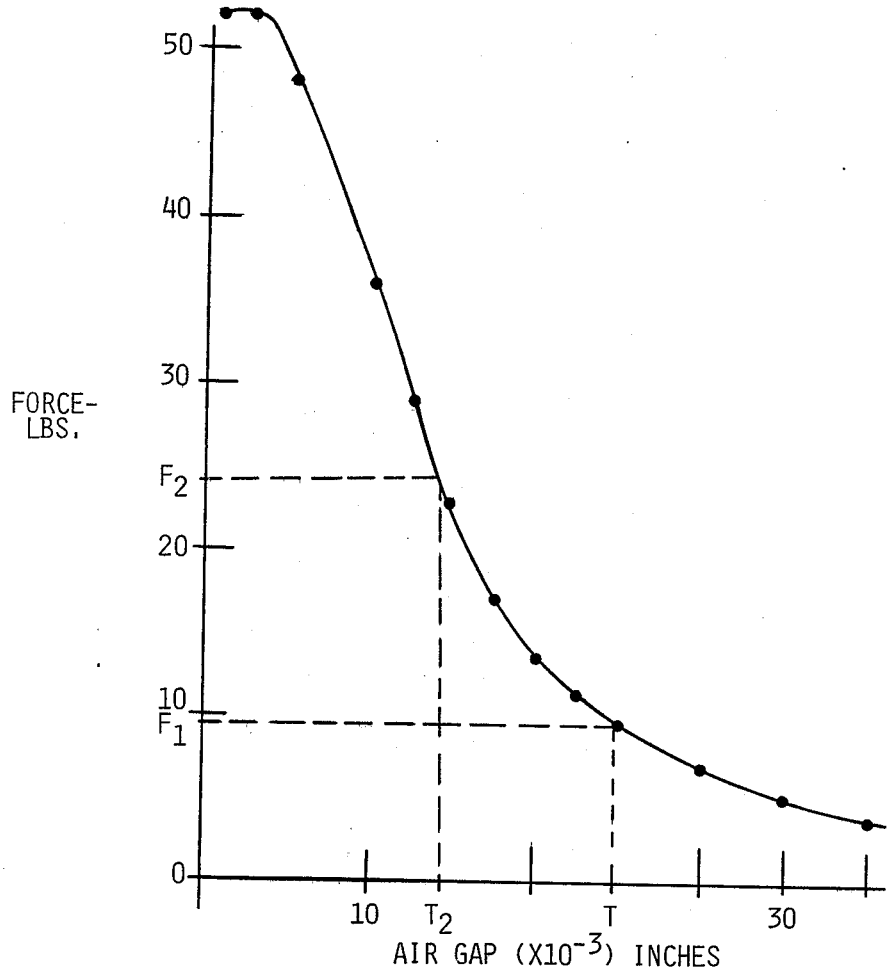
FIG. 5 illustrates a graph of the electromagnetic force as a function of air gap.

It is apparent from FIG. 5 that as the air gap increases, the available electromagnetic attractive force (F) significantly and rapidly decreases so that at distances in excess of 0.04 inches the force available for actuation (of the armature 70) is small. Consequently, if the stroke of the solenoid is to be large (i.e., 0.04 inches) it would have been required as in prior art solenoids to increase the exciting current, which increases power requirements or to enlarge the dimensions of the electromagnet 60 or armature pole pieces (72, 78) thereby increasing actuator size and weight which further reduces the solenoid response time. The present invention obviates these problems as can be seen from the following discussion.

As previously described, the solenoid 20 in its deactivated or unenergized state will permit the spring 100 to bias the armature 70 at an extreme position relative to the stator or electromagnet 60 therein defining a bi-level air gap.

A controller (not shown) will, upon demand, energize the coil 66 with a predetermined current producing a determinable electromagnetic force between the stator 60 and both armature pole pieces (72 and 78), respectively. As an example, assume the inner pole face 74 is disposed within the housing 30 in the de-energized state at a distance T from the stator 60 and further assume the rear pole piece 78 (which partially envelopes the inner pole piece 72) is disposed so that its pole face 79 is at a distance $T_2$, wherein $T_2=T/2$, from the stator 60. Upon energizing the coil 66, a magnetic force $F_1$ will be exerted on the farther situated inner pole piece 72. In addition, a substantially larger magnetic force of attraction $F_2$ will be exerted upon the closer or rear pole piece 78. The magnitude of the force $F_2$ can be obtained from FIG. 5 and is sized to be sufficiently large to cause the entire armature 70 to move towards the stator 60. As the rear pole piece 78 moves towards the stator 60, it engages and carries with it the inner pole piece 72 thereby moving the piston 84 and the associated valve or apparatus from their respectively biased positions closer to the housing.

The rear pole piece 78 will continue to move to the electromagnet 60 until it contacts the spacer 69. It is believed that the spacer 69 can be totally or partially eliminated from the invention. The spacer 69 is one method of controlling the minimum air gap between electromagnet 60 and armature 70.

Figure 8:
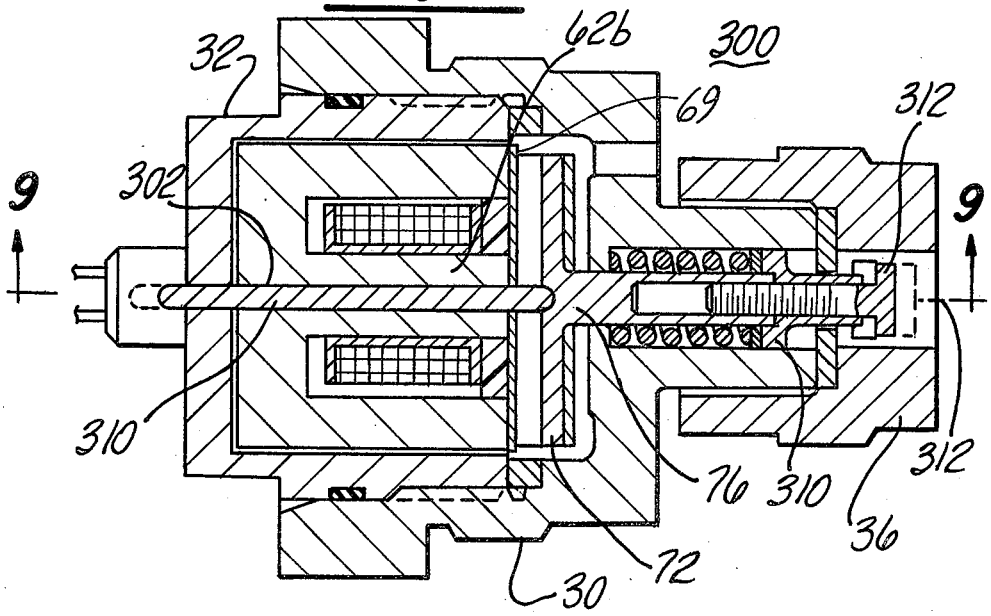
FIG. 8 is a further modification of the present invention.
Figure 9:
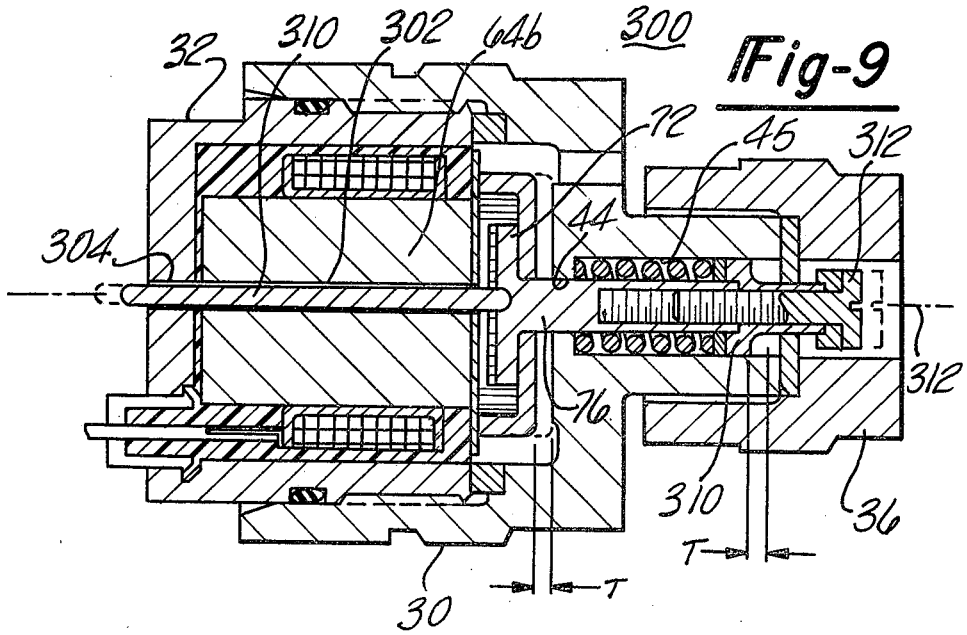
FIG. 9 is a sectional view through Section 9—9 of FIG. 8.

As the inner pole piece 72 is moved toward the stator 60 by the movement of rear pole piece 78, its respective air gap is similarly reduced. Consequently, by virtue of this smaller spacing, the magnetic force acting upon the inner pole piece 72 will sufficiently increase to a level which will permit the inner pole piece 72 to overcome the spring bias force and continue to move to the electromagnet 60 (or spacer 69) after the rear pole piece 78 has stopped. Therefore, the motion of the piston 84 and associated parts in response to an actuation command is a multi-step process comprising a first segment wherein the piston 84 is moved by the rear pole piece 78 and a second segment characterized by increased magnetic forces acting upon the inner pole piece 72 permitting forces acting upon the inner pole piece 72 permitting the inner pole piece 72 and piston 84 to overtravel relative to the rear pole piece 78 and to continue to move into the electromagnet 60. Other methods of halting the motion of the inner pole piece would include incorporating mechanical stops (not shown) to limit the armature travel or sizing the armature 70 so that the valve seat 90 engages the valve plate 96 prior to the time that inner pole piece 72 engages the electromagnet 60 as shown in FIGS. 8 and 9.

In this manner, an extended stroke solenoid 20 is achieved by positioning the telescoping armature 70 relative to the electromagnet 60 to produce an unequal or non-linear force therebetween. In addition, it should be noted that the bi-level (or multi-level) air gaps of the telescoping armature 70 provides a means for electromagnetic force multiplication. This can be seen from the following example:

If both pole pieces (72 and 78) were situated at the extreme air gap (T), the resultant force acting upon the armature 70, assuming equal pole piece facial areas, would be $2F_1$. However, utilizing the multi-level air gap, the resultant forces acting upon the armature $(F_1+F_2)$ is larger than the previously discussed resultant force for the same exciting current.

Figure 6:
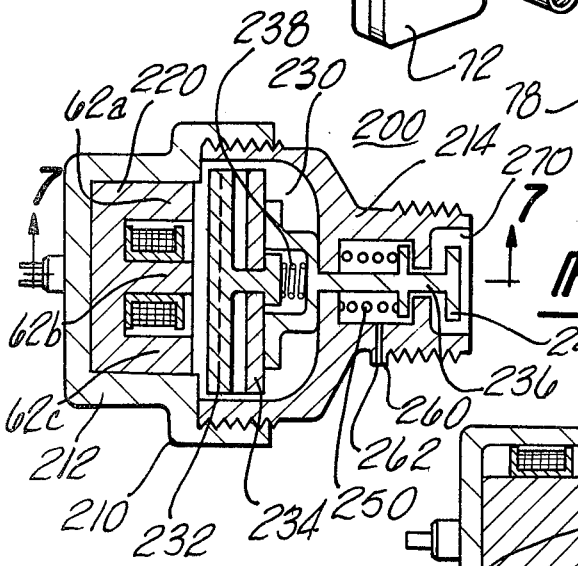
FIG. 6 is a sectional view illustrating an alternate embodiment of the present invention.
Figure 7:
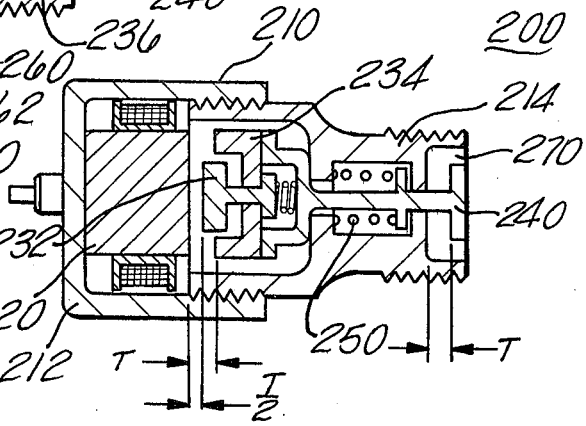
FIG. 7 is another sectional view through Section 7—7 of FIG. 6.

Reference is made to FIGS. 6 and 7 which illustrate an alternate embodiment of the present invention; more particularly, an alternate configuration of an armature having two telescoping pole pieces. The alternate solenoid 200 contains a multi-portion housing 210 having a base portion 212 and armature receiving portion 214 enclosing an electromagnet 220, armature 230 and valve 240. As previously described in the prior embodiment, a spring 250 biases the armature against the armature receiving portion 214 of the housing 210. The armature 230 comprises, as before, an inner member including an inner pole piece 232 and a receiving member including a rear pole piece 234. However, in this alternate embodiment, the inner pole piece 232 is disposed closer to the electromagnet 230 is than the rear pole piece 234. The inner pole piece 232 is telescopically received within the rear pole piece 234, however, in this embodiment the piston 236 and valve 240 are attached to the rear pole piece 234. It may be desireable to insert a second spring such as the helical spring 238 having a low spring constant between the inner pole piece 232 and rear pole piece 234 to maintain the desired separation during deactivated periods.

The dynamics of armature movement are similar to that previously described and will not be described in detail. However, in this embodiment it is the front pole piece 232 which is attracted to the electromagnet 220 and initially pulls the rear pole piece 234 toward the electromagnet 220. As the inner pole piece 232 approaches the electromagnet 220, the magnetic forces acting upon the rear pole piece 234 to increase to a level permitting the rear pole piece 234 to overtravel relative to the inner pole piece 232 permitting the extended stroke.

FIG. 6 illustrates a further modification of the solenoid 200 wherein the housing 210 is provided with a port 260 adapted to receive an external pressure, vacuum or fluid (not shown). In addition, the port 260 contains a passage 262 which extends into the housing 210. The external pressure, vacuum or fluid is selectively communicated to bore 270 in correspondence to the opening and closing of valve 240.

Inspection of the previously described embodiments illustrate that the solenoids are designed to draw the slide or piston or associated apparatus towards the housing upon activation and permit the slide, piston, etc., to reassume its pre-activation position by moving outward when the electric actuation commands are removed.

FIGS. 8 and 9 illustrate modifications to the preferred embodiment which will enable the solenoid 300 to extend member 310 upon activation. A comparison of FIGS. 8 and 9 with FIGS. 1 and 3 reveals the nature of these modifications. One modification is that threaded member 88 (which may be the cooperating part of an associated apparatus) has been replaced by cap screw 312 or threaded plate. The center leg 62 of the E-type electromagnet is provided with a passage 302 and the base portion 32 of the housing 30 is further provided with an opening or passage 304 which is coaxial to the passage 302.

A second slide or piston 310, slidably disposed in passages 302 and 304, is shown connected to the inner member, i.e., the front pole piece 72. It is preferable to align the piston 310, and passages (302,304) to an axis 312 which is colinear to the center of the rod 76 and bores 44 and 45. The slide or piston 310 may be an integral part of the inner pole piece 72, however, it is preferable to fabricate the slide or piston 310 from a non-ferromagnetic material which is connected to the inner pole piece 72. It is not necessary for the entire inner or rear pole pieces (72 and 78) be fabricated from ferromagnetic materials. Non-ferromagnetic material such as aluminum or plastic may be substituted for the majority of the bulk of the pole pieces with ferromagnetic, preferably laminated, inserts comprising the pole-faces 74 and 79. Furthermore, since a portion of the center leg 62*b* in FIGS. 6 and 7 is removed to accommodate the passage 302, design considerations may require a compensatory enlargement of the center leg 62*b*.

Figure 10:
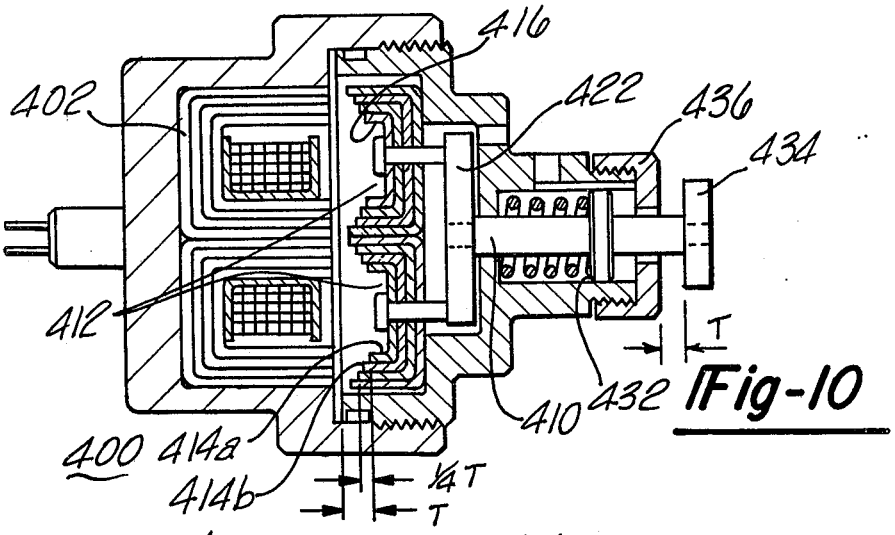
FIG. 10 is a sectional view of an alternate embodiment of the invention.
Figure 11:
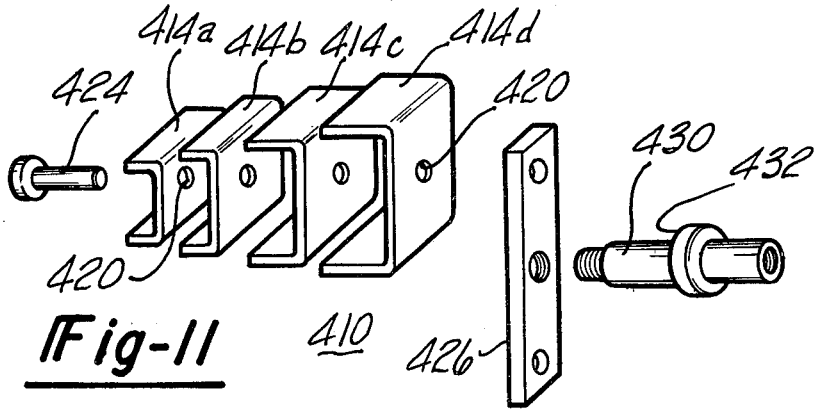
FIG. 11 is an exploded view of a portion of the armature shown in FIG. 10.
Figure 12:
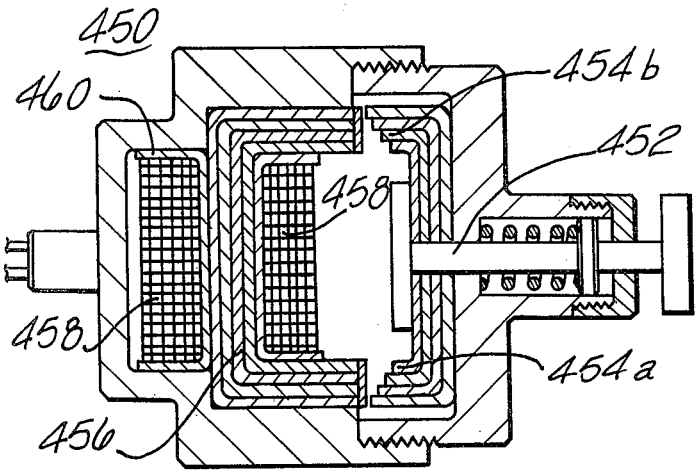
FIG. 12 illustrates still another embodiment of the present invention.

Reference is now made to FIGS. 10–12 which illustrate further embodiments of the present invention. FIGS. 10 and 11 illustrate a solenoid 400 incorporating an E-type electromagnet 402 and an armature 410 having a rear pole piece 412 fabricated from a plurality of nested laminated members 414*a*–*d* and an identical set of nested members 416*a*–*d*. Each of these members 414 and 416 are respectively received one into the other and define a non-linear air gap (T, $\frac{3}{4}$T, $\frac{1}{2}$T, $\frac{1}{4}$T) with respect to the electromagnet 402. Each member contains a centrally located coaxial passage 420 sized to receive a portion of the inner member 422, more particularly, pin 424. The inner member comprises a pair of pins 424 (only one is shown in FIG. 11) each of which is received within a holder 426 and an armature shaft or piston 430 which contains a spring reaction shoulder 432. The armature shaft 430 threadably receives valve 434. The armature 410 is contained within the solenoid 400 by housing 432.

FIG. 12 illustrates solenoid 450 showing another armature 452 having a plurality of nested members 454 *a*–*d*. In addition, solenoid 450 illustrates a C-type electromagnet having laminates 456 having at least one coil if wire 458 wound about bobbin 460.

It is apparent that other electromagnets may be substituted for the E-type electromagnet. In addition, the design can be modified to accommodate other than rectangular pole pieces, which were chosen to conform with rectangular electromagnets. Consequently, changes and modifications in the above-described embodiments can, of course, be carried out without departing from the scope thereof. Accordingly, that scope is intended to be limited only by the scope of the appended claims.

What is claimed is:

1. A valve responsive to electrical command signals comprising:

a housing including a first passage extending therethrough and a fluid port adapted to receive fluid in communication therewith;

magnetic means, disposed within said housing for developing a magnetic field in response to the electric commands input thereto;

telescoping armature means including a plurality of members disposed within said housing between said magnetic means and said first passage for moving each of said members toward said magnetic means in a telescoping manner in response to said magnetic field, said telescoping armature means comprising:

a substantially rectangular first member that is responsive to said magnetic field, receiving means responsive to the magnetic field for receiving and for moving said first member, said receiving means including a rectangular member having a U-shaped cross-section, said rectangular member having a rear wall having a hole therein and two opposingly situated sidewalls, said rear wall and said side walls forming a receiving cavity therebetween;

piston means slidably received through said rear wall and operatively connected to said first member and extending through said first passage for reciprocally moving within said first passage in response to the motion of said first member and for opening and closing said fluid first passage to permit fluid flow therethrough;

biasing means connected to said piston means for biasing said first member absent electric command signals into said receiving means in a spaced relationship relative to said magnetic means.

2. An apparatus responsive to electrical command signals comprising:

a housing including a first passage extending therethrough, magnetic means, disposed within said housing for developing a magnetic field in response to the electric commands input thereto;

telescoping armature means including a plurality of members disposed within said housing between said magnetic means and said first passage for moving each of said members toward said magnetic means in a telescoping manner in response to said magnetic field, piston means operatively connected to said telescoping armature means extending through said first passage for reciprocally moving within said first passage in response to the motion of said telescoping armature means;

biasing means connected to said telescoping armature means for biasing said telescoping armature, absent electric command signals, in a spaced relationship relative to said magnetic means; and wherein said housing further includes a second passage opposite said first passage and where said magnetic means includes a third passage in alignment with said second passage, second piston means movably situated within said second and said third passages and operatively connected to at least one member of said plurality of members of said telescoping armature means or reciprocally moving relative to said second and said third passages in response to the movement of said telescoping armature means.

3. An apparatus comprising:

a housing having a first passage therethrough;

an E-type electromagnet disposed within said housing for developing a magnetic field in response to electrical command signals input thereto;

an armature telescopically disposed within said housing comprising a first member and receiving means for telescopically receiving said first member, said first member including;

a magnetically attractable rectangular first pole piece having a first pole face maintained in the absence of said command signals a first distance from said electromagnet;

piston means connected to and extending from said first member, opposite said first pole face for slidably moving through said first passage;

said receiving means including a rectangular receiving member having a U-shaped cross-section and a walled portion defining a cavity therein of substantially the same shape as said first pole piece for telescopically receiving said first member, said walled portion having at least one hole therethrough for slidably accepting said piston means, said receiving member further having a second magnetically attractable portion, having a pole face thereon, wherein said pole face is maintained, absent said command signals, a second distance from said electromagnet; and where said receiving means in response to said magnetic field moves toward said electromagnet engaging said first member and simultaneously moving said first member and said piston means toward said electromagnet, said first member in response to said magnetic field telescopically moving from said cavity after the motion of said receiving member has ceased.

4. The valve as defined in claim 1 wherein said receiving means includes a plurality of U-shaped members adapted to be slidably receiving one member into an adjacent member wherein each member comprises a rear wall having a hole therein, and a pair of sidewalls defining a receiving cavity such that when each said member is biased into an adjacent member the ends of said sidewalls of each of said members are maintained at different distances from said magnetic means.

5. The valve as defined in claim 4 wherein said magnetic means is an E-type electromagnet.

6. The valve as defined in claim 5 wherein the end of the sidewall of each outermost member is maintained, absent command signals, closer to said electromagnet that the next innermost of said members.

7. A valve responsive to electrical command signals comprising:

a housing including a first passage extending therethrough and a fluid port adapted to receive fluid in communication therewith;

magnetic means, disposed within said housing for developing a magnetic field in response to the electric commands input thereto;

telescoping armature means including a plurality of members disposed within said housing between said magnetic means and said first passage for moving each of said members toward said magnetic means in a telescoping manner in response to said magnetic field, said telescoping armature means comprising:

a substantially rectangular first member that is responsive to said magnetic field;

receiving means responsive to the magnetic field for receiving and for moving said first member, said receiving means including a rectangular member having a U-shaped cross-section, said rectangular member having a rear wall having a hole therein and two opposingly situated sidewalls, said rear wall and said side walls forming a receiving cavity therebetween;

piston means slidably received through said rear wall and operatively connected to said first member and extending through said first passage for reciprocally moving within said first passage in response to the motion of said first member and for opening and closing said fluid first passage to permit fluid flow therethrough;

biasing means connected to said piston means for biasing said first member absent electric command signals apart from said receiving means in a spaced relationship relative to said magnetic means.

* * * * *